US005701642A

United States Patent [19]

Order

[11] Patent Number: 5,701,642

[45] Date of Patent: Dec. 30, 1997

[54] ECOLOGICAL BURIAL METHOD AND APPARATUS

[76] Inventor: Stanley E. Order, 26 Acadia Dr., Voorhees, N.J. 08043

[21] Appl. No.: 697,392

[22] Filed: Aug. 27, 1996

[51] Int. Cl.[6] ..... A61G 1/00

[52] U.S. Cl. ..... 27/4; 27/2; 47/48.5

[58] Field of Search ..... 27/1, 4; 47/48.5, 47/74

[56] References Cited

U.S. PATENT DOCUMENTS

| | | | |
|---|---|---|---|
| 3,923,729 | 12/1975 | Clendinning et al. | 260/40 R |
| 4,156,956 | 6/1979 | Partridge et al. | 27/4 |
| 4,552,484 | 11/1985 | Nuttle | 405/128 |
| 5,096,650 | 3/1992 | Renna | 264/322 |
| 5,239,733 | 8/1993 | Vail, III et al. | 27/19 |
| 5,279,658 | 1/1994 | Aung | 106/154.1 |
| 5,301,872 | 4/1994 | Tusing et al. | 229/117.03 |
| 5,317,834 | 6/1994 | Anderson | 47/48.5 |
| 5,346,929 | 9/1994 | Guttag | 523/124 |

FOREIGN PATENT DOCUMENTS

| | | | |
|---|---|---|---|
| 623717 | 4/1994 | European Pat. Off. | 47/48.5 X |
| 9423685 | 10/1994 | WIPO | 47/48.5 X |

*Primary Examiner*—Kien T. Nguyen

*Attorney, Agent, or Firm*—Caesar, Rivise, Bernstein, Cohen & Pokotilow, Ltd.

[57] ABSTRACT

An ecological burial apparatus and method are accomplished by placing a corpse into a coffin structure made of a material containing a nutrient or fertilizer or combinations thereof. The corpse and coffin structure are buried in the ground and a tree is planted above the coffin structure so that when the coffin structure biodegrades the nutrient or fertilizer or combinations thereof are capable of being supplied to the tree to create an ecologically sound environment.

3 Claims, 3 Drawing Sheets

FIG. 4
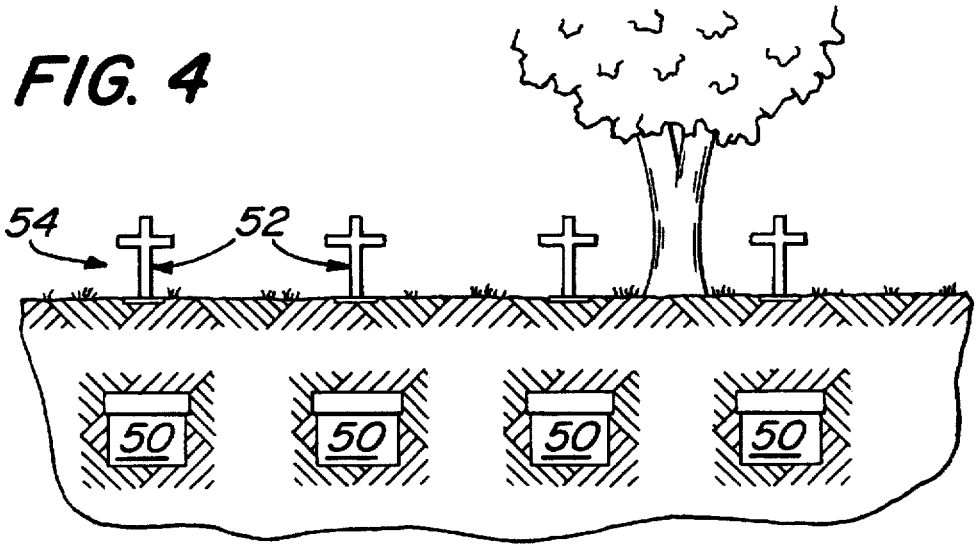
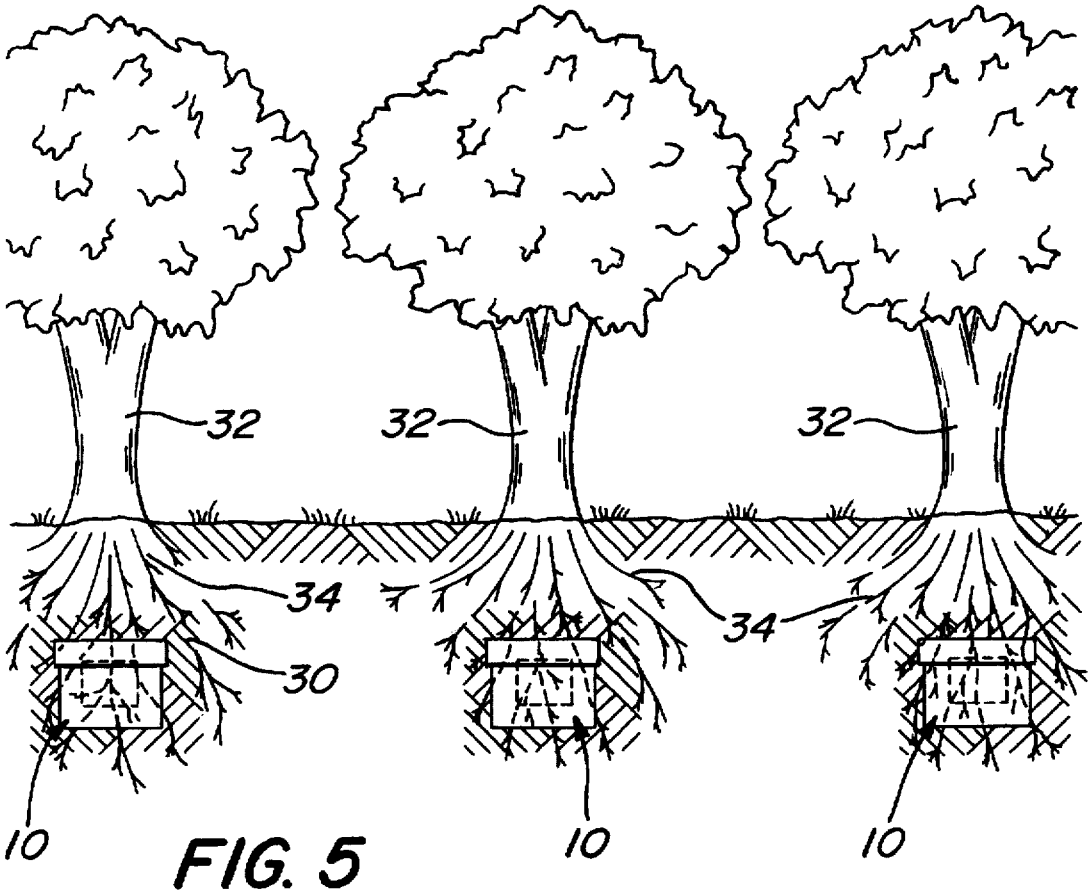
FIG. 5

ECOLOGICAL BURIAL METHOD AND APPARATUS

RELATED APPLICATIONS

This application claims the benefit of the filing date of provisional application Ser. No. 60/004,535, filed Sep. 29, 1995, the entire disclosure of which is incorporated by reference herein.

BACKGROUND OF THE INVENTION

Present day burial practices include those which consist of the fixation of the deceased with toxic chemicals. The body is then contained in a coffin (usually wood or metal) and placed in the ground with a metal, stone, or other commemorative symbol over the grave site as shown in FIG. 4. This leads to the use of land sites as cemeteries which are unattractive to the community. Further, the preservation of the body is not consistent with a return of human composition to the natural elements of the world.

Accordingly, there exists a need for an ecologically sound burial practice and method which overcomes these and other deficiencies as shown in FIG. 5.

SUMMARY OF THE INVENTION

An ecological burial apparatus and method are accomplished by placing a corpse into a coffin structure made of a material containing a nutrient or fertilizer or combinations thereof. The corpse and coffin structure are buried in the ground and a tree is planted above the coffin structure so that when the coffin structure biodegrades the nutrient, fertilizer or combinations thereof are capable of being supplied to the tree to create an ecologically sound environment and an aesthetically pleasing field of trees.

DESCRIPTION OF THE DRAWINGS

Other objects and many attendant features of this invention will become readily appreciated as the same becomes better understood by reference to the following detailed description when considered in connection with the accompanying drawings wherein:

FIG. 4 is a side view of a conventional burial park showing a series of typical grave sites with a conventional coffin buried in the ground with a burial marker placed above each grave site.

FIG. 5 is a side view of an ecological burial park in accordance with the present invention showing a series of grave sites with a coffin structure made in accordance with the present invention buried in the ground with tree planted above each grave site.

DETAILED DESCRIPTION OF THE PREFERRED EMBODIMENTS

The apparatus and method of the present invention places the body of a deceased person (or animal) within a composite material comprising nutrients for a tree to be planted above the burial site. Such nutrients include, but are not limited to, nitrogen in the approximate range of 2–16% by weight, phosphoric acid in the approximate range of 2–15% by weight, and potash in the approximate range of 2–15% by weight. The nutrients may be combined with the constituents of the container made of a biodegradable material such as biodegradable plastic or paper in accordance with methods conventional in the art.

Figure 1:
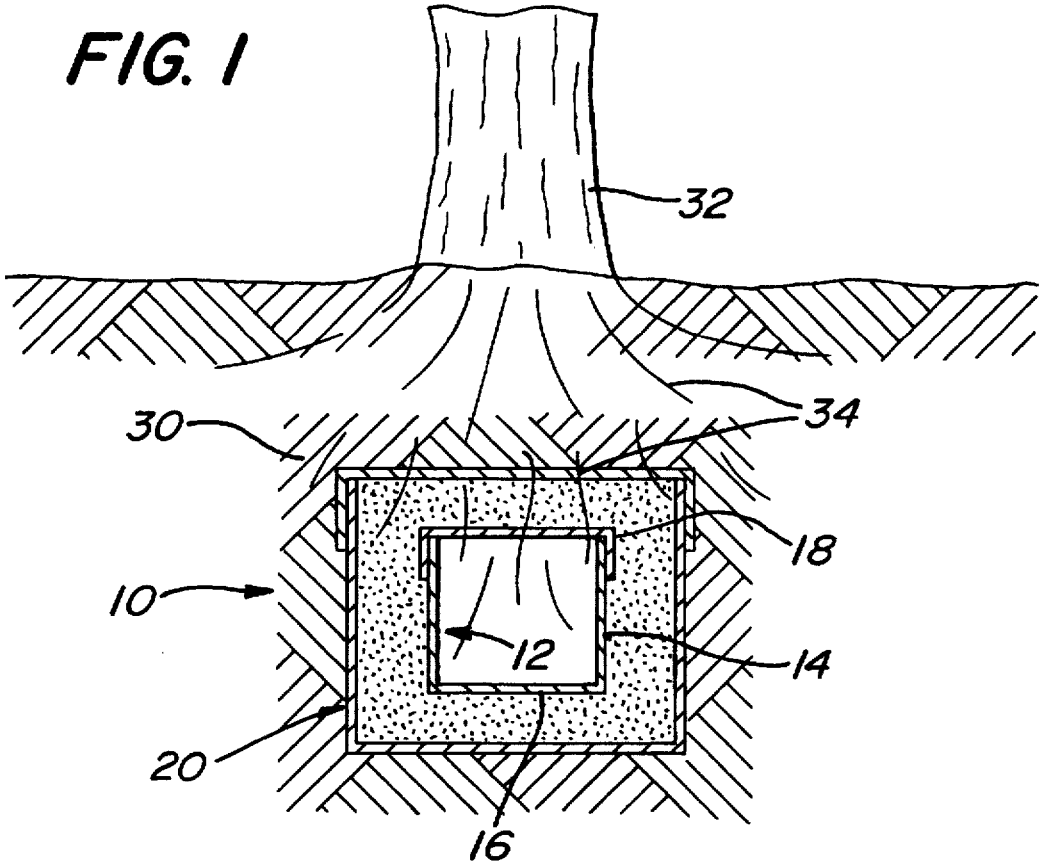
FIG. 1 is a sectional view of a coffin structure of the present invention, buried in the ground beneath a tree, with the tree roots growing into and about the coffin structure to feed on the nutrients and fertilizer contained therein.
Figure 2:
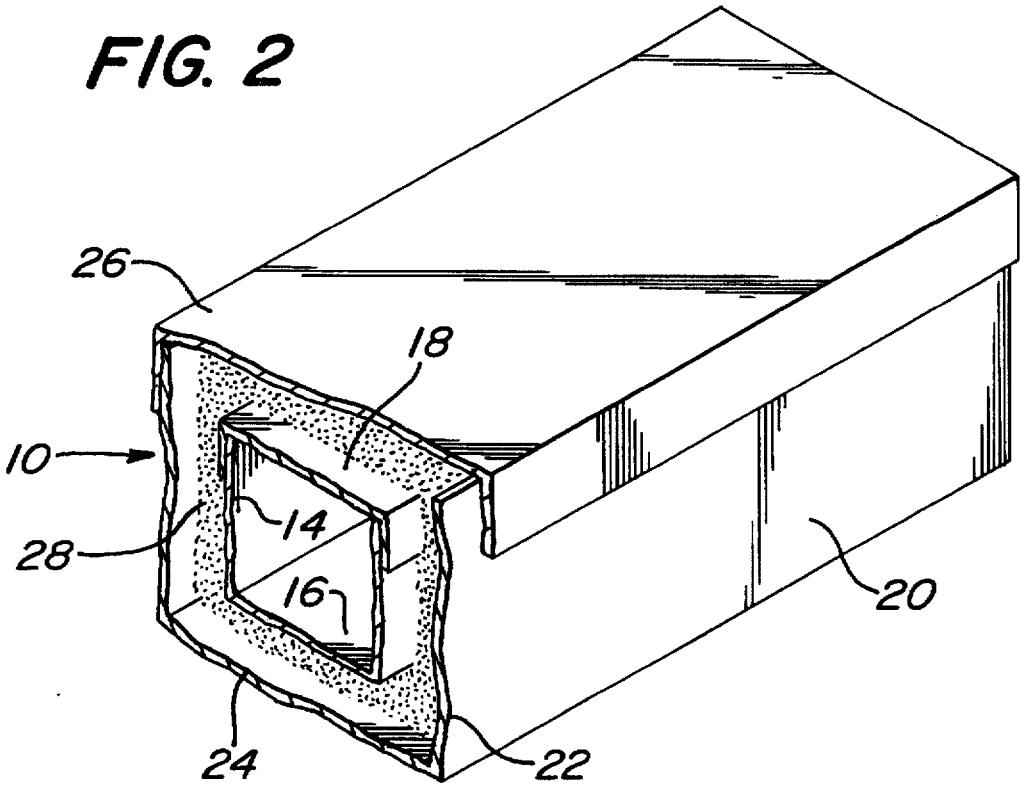
FIG. 2 is an isometric view of a coffin structure of the present invention shown partially in section.
Figure 3:
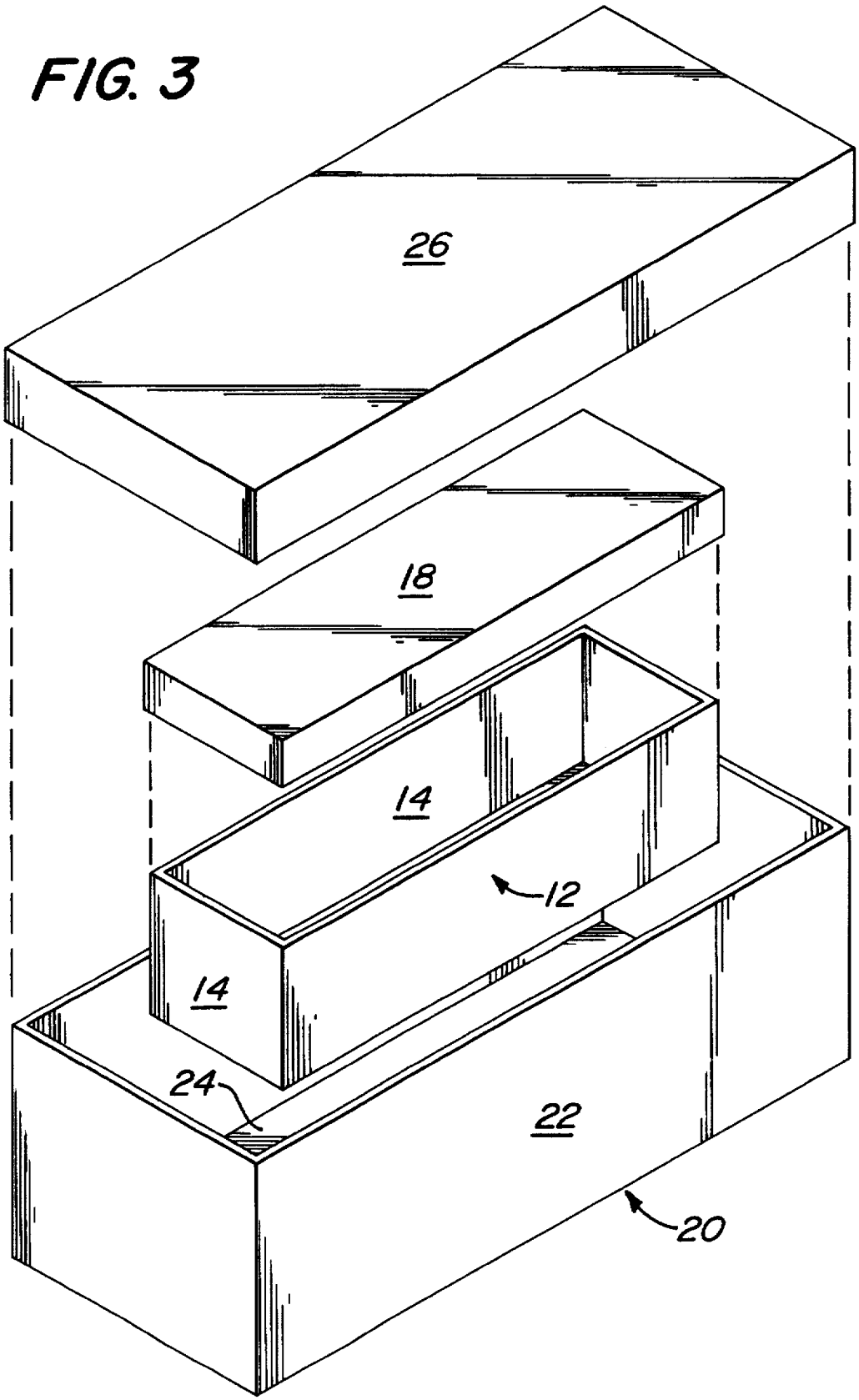
FIG. 3 is an exploded isometric view of a coffin structure of the present invention prior to interment.

As shown in FIGS. 1–3, the coffin structure 10 comprises an interment box 12 comprised of sidewalls 14, base 16 and removable lid 18. The deceased (not shown) is placed within the interment box 12 and the lid 18 is placed over the box. The interment box 12 then placed within an outer box 20, comprised of sidewalls, 22, base 24 and removable lid 26. In between the interment box 12 and the outer box 20, one may choose to place soil 28, nutrients or other materials to enhance the degradation process of the coffin structure 10 by increasing the area of contact of the coffin structure with the surrounding environment.

As shown in FIG. 1, the deceased and coffin structure 10 are then buried in the ground at a grave site. A suitable tree 32 which can be chosen by the family members to commemorate the individual, is then planted above the grave site. As the tree 32 matures its roots shown by lines 34 will grow downward and about the coffin structure 10. The tree 32 and roots 34 will feed on the nutrients contained in the coffin structure 10 as it degrades over time being exposed to the soil, rain and other environmental conditions. Additionally, one may choose to place a small marker (not shown), bearing the deceased person's name and/or other indicia as appropriate.

As shown in FIG. 5, as the trees 32 develop over time and as numerous individuals are buried in the burial park, the resultant burial park will truly be a park consistent with a natural environment by the planting of the trees 32 with a nutrient source conducive to that tree. The molecular structure of the decaying body would in time, enter into the natural ecological system of the world and create a more affirmative environment for the society. Thus, the present invention creates a truly unique, beautiful and ecologically sound burial park, in contrast to prior art burial parks as shown in FIG. 4. FIG. 4 depicts a series of conventional coffins 50, typically made of metal or other non-biodegradable materials, which may be interred in a concrete chamber (not shown) to prevent the ravages of the environment from reaching the coffin and the deceased contained therein. The coffins 50 are buried in the ground and a conventional marker 52 made of metal, stone, marble, etc. is placed above the grave site. Thus, a park 54 consisting of a plurality of these markers 52 which do not have a positive contribution to the ecology results. In time, the burial park 54 will be full and the park will require continual maintenance to ensure that grass, weeds, etc. are trimmed from about the markers 52 to prevent them from being obscured.

By adjusting the nutrient content of the coffin, one can adapt the nutrient content and pH thereof to the particular species of tree which is to be planted above the individual burial site. For example, a conifer tree may require or prefer different nutrients than a fruit or flower bearing tree. Thus, in accordance with nutrient requirements conventional in the art, one could adapt the nutrient content in accordance with the tree requirements.

In order to make the biodegradable composite coffin 10 of the present invention, one can make it of a wide variety of suitable materials. Such materials include, but are not limited to biodegradable plastics and/or paper and/or wood. Examples of such materials are disclosed in the following United States Letters Patents, the entire disclosures of which are incorporated by reference herein.

U.S. Pat. No. 5,346,929 discloses a biodegradable plastic and articles made therefrom.

U.S. Pat. No. 5,301,872 discloses a collapsible pallet container for the containment of various articles including bulk materials.

U.S. Pat. No. 5,279,658 discloses a composition for forming into shaped articles and the process for doing so. That patent discloses biodegradable containers which disintegrate when placed in the ground and are used for plant cultivation, citing European Patent Application No. 355,250, also incorporated by reference herein.

U.S. Pat. No. 3,923,729 discloses a biodegradable transplanter container made from a biodegradable thermoplastic and naturally occurring material such as fir bark. The containers possess a germination medium and optionally a seed or seedling therein.

U.S. Pat. No. 5,096,650 discloses a method of forming biodegradable paperboard containers.

One can either first envelope the deceased in a layer of the desired nutrient mixture, e.g., by combining the nutrients with a binder material conventional in the art, e.g., paraffin wax or any other biodegradable material, or combine the nutrients with the biodegradable material which will be made into the coffin and then mold the coffin in the appropriate size and shape.

The coffin may be manufactured using conventional methods for pressing or molding biodegradable containers as incorporated by reference to the above patents. The coffin may be adorned with any appropriate symbols and the coffin may be painted in accordance with personal preferences or may be textured or otherwise altered for aesthetic purposes.

A kit for the ecological burial of pets has been similarly designed to that as shown in FIGS. 1–3. The kit consists of a limiting box or outer container which can be made of wood, composition material, and does not necessary have to be degradable. Preferably, however, it is biodegradable to permit the maximum amount of degradation and thus return of nutrients to the soil. This box is the size required for the cavity in the ground. The box is placed in the ground and then within the box is placed the internment box or coffin structure. The internment box is biodegradable and will contain the pet. It is at least one foot removed centrally from the peripheral limiting box to permit soil to be placed between the internment box and the limiting box. The limiting box allows definition of the area of burial. The internment box will have the same nutrients placed in its base as a capsular or powdered material as previously described and then the pet is placed on top of this layer and then an additional layer placed over the pet and finally a lid of the biodegradable material covers the box. The entire set of boxes is then covered with ground and an appropriate plant is placed over the nutrient region. Both boxes may be supported by composite material in order to bear weight appropriately. The material can be wood chips, wood, dense composition cardboard, biodegradable plastic and other materials known in the art.

I claim:

1. An ecological burial apparatus comprising a coffin structure comprising an inner and outer container, the inner and outer containers each having a bottom, side walls and a top lid, the coffin structure comprised of a biodegradable material and a nutrient or fertilizer or combinations thereof for a tree placed adjacent the coffin structure when the coffin structure is buried in the ground, so that when the coffin structure is placed into the ground the coffin structure will biodegrade and release the nutrient or fertilizer into the ground to feed the tree adjacent the coffin structure.

2. An ecological burial method comprising the steps of:

(a) placing a corpse into a coffin structure as defined in claim 1;

(b) burying the corpse and coffin structure in the ground;

(c) planting a tree above the coffin structure so that when the coffin structure biodegrades the nutrient or fertilizer or combinations thereof are capable of being supplied to the tree.

3. The method of claim 2 additionally comprising the step of placing soil between the coffin structure and outer container, prior to burying the corpse, coffin structure and outer container into the ground.

* * * * *